US005186347A

United States Patent [19]

Freeman et al.

[11] Patent Number: 5,186,347

[45] Date of Patent: Feb. 16, 1993

[54] SPILL-PROOF CLOSURE

[76] Inventors: Mark A. Freeman, 15317 W. 91st Pl., Lenexa, Kans. 66219; Timothy K. Stringer, 8921 W. 80th, Overland Park, Kans. 66204

[21] Appl. No.: 776,793

[22] Filed: Oct. 15, 1991

[51] Int. Cl.[5] ..... B65D 51/18

[52] U.S. Cl. ..... 220/254; 220/714; 222/189

[58] Field of Search ..... 215/11.1, 11.4; 222/189; 220/705, 713, 714, 254

[56] References Cited

U.S. PATENT DOCUMENTS

| | | | |
|---|---|---|---|
| 2,534,614 | 12/1950 | Michael | 220/713 |
| 2,569,139 | 9/1951 | Abelson | 215/11.1 |
| 2,816,548 | 12/1957 | Tupper | 220/713 X |
| 3,372,832 | 3/1968 | Yeater et al. . | |
| 3,905,512 | 9/1975 | Albert et al. . | |
| 3,964,631 | 6/1976 | Albert . | |
| 4,138,033 | 2/1979 | Payne et al. | 220/254 |
| 4,238,045 | 12/1980 | D'Andria . | |
| 4,245,752 | 1/1981 | Prueher | 220/266 |
| 4,361,249 | 11/1982 | Tuneski et al. | 220/254 |
| 4,441,624 | 4/1984 | Sokolowski | 220/254 |
| 4,582,214 | 4/1986 | Dart et al. . | |
| 4,756,440 | 7/1988 | Gartner . | |
| 4,796,774 | 1/1989 | Nabinger . | |
| 4,921,112 | 5/1990 | Juhlin et al. | 215/11.4 |
| 4,946,062 | 8/1990 | Coy . | |
| 5,050,758 | 9/1991 | Freeman et al. . | |

*Primary Examiner*—Stephen Marcus
*Assistant Examiner*—Nova Stucker

[57] ABSTRACT

A spill-proof closure for containers used in dispensing liquid beverages. The closure has a spout containing a thin membrane at or near the upper end. The thin membrane includes a through slit which remains closed except when external suction is applied during normal drinking.

20 Claims, 3 Drawing Sheets

SPILL-PROOF CLOSURE

Background—Field of the Invention

This invention relates to a closure for a beverage container and is particularly concerned with closures which remain in place while drinking and are spill-proof.

Background—Description of Prior Art

In some prior art arrangements, the closures have a spout containing an opening typically in the form of a slot or a plurality of apertures. These openings provide a flow passage for withdrawal of the contained liquid and reduce the amount of liquid that spills if the container is tipped or overturned. The disadvantage of prior art arrangements of this approach is the spillage is only reduced, not eliminated.

Another approach to the problem has been to provide a valved spout arrangement. However, prior art embodiments of this approach are relatively complex, multi-piece structures which do not lend themselves to mass production methods. Also, for some of these devices to function properly a resilient spout is required, but is not always desirable.

Objectives and Advantages

The main objective of the present invention is to provide a closure which overcomes the disadvantages previously stated.

Another objective of the present invention is to provide a closure for a container, specifically designed to handle liquid beverages, that provides a means of communication between the interior and exterior of the container only when withdrawal of the liquid beverage is desired.

It is a further objective of the present invention to provide a means in which a partial vacuum or suction is used to form an opening through a thin membrane and when the partial vacuum or suction is released the opening automatically closes.

DRAWING FIGURES

REFERENCE NUMERALS IN DRAWINGS

Figure 1:
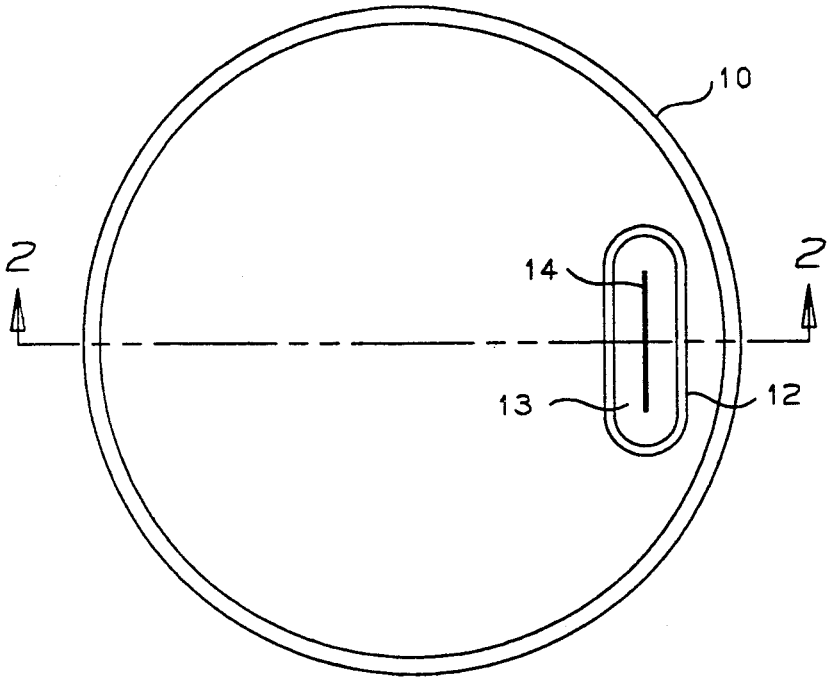
FIG. 1 is a top view of a spill-proof closure in the closed position.
Figure 2:
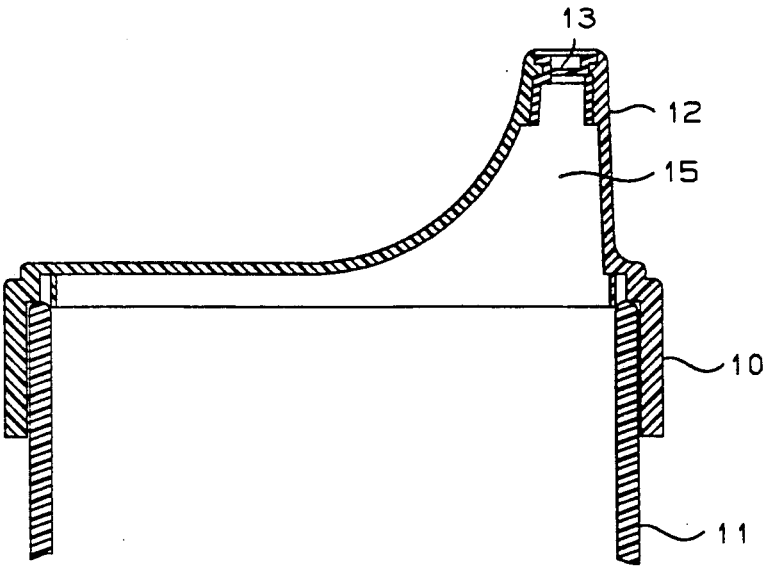
FIG. 2 is the cross-sectional view taken as indicated by section line 2—2 applied to FIG. 1.

10 Closure
11 Beverage container
12 Spout
13 Thin membrane
14 Slit
15 Central passageway
16 Punctured holes

Description—FIGS. 1 through 5

Referring to the drawings the spill-proof closure of the present invention is indicated as reference numeral 10 and the beverage container is numeral 11. The closure 10 may be made of a rigid material such as polypropylene, polyethylene, or the like and is intended to be reusable. The beverage container 11 may also be formed using materials of the same type. The closure 10 is circular in shape, having a substantially planar cover portion and may vary in size depending upon the size of the beverage container 11. The thin membrane is indicated as numeral 13 and may be made of formable materials such as Santoprene, Kraton, Neoprene, Latex, or other elastomers or flexible materials. The thickness of the thin membrane 13 may range from 0.001 inches to 0.100 inches. The spout 12 is an integral part of the closure 10 and extends outwardly from the top surface thereof and near the outer periphery thereof. The spout 12 is generally ovoid in cross-section and has a central passageway 15 which is open at the lower end so as to communicate with the interior of the beverage container 11. The upper end of spout 12 is open prior to the assembly or insertion of the thin membrane 13 which is insert molded or otherwise attached to the inner surface of spout 12. This provides sealing engagement between the periphery of the inner surface of the spout 12 and the outer surface of the thin membrane 13, thus preventing leakage in this area. The thin membrane 13 seals off or denies communication between the interior and exterior of the beverage container 11. Thus, slit 14, which functions as a valve during operation, is the only means of communication between the interior and exterior of the beverage container 11. Slit 14 is through thin membrane 13 and is shown as a single straight line but could be multiple slits and/or a variety of geometric shapes such as a figure "H", a curved line, etc. In the open position shown in FIG. 3, the thin membrane 13 is stressed causing slit 14 to form an opening through thin membrane 13. In the manufactured or closed position shown in FIG. 1, the thin membrane 13 is unstressed allowing slit 14 to remain closed.

Figure 6:
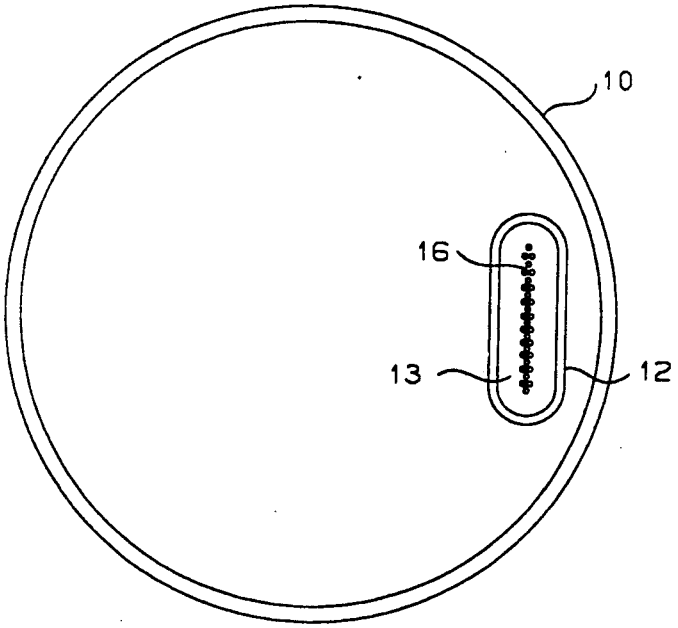
FIG. 6 is a top view of a modified spill-proof closure.

Another alternative for similar purposes is specifically shown in FIG. 6 wherein the thin membrane 13 does not contain slit 14, but rather a plurality of punctured holes 16. In all other respects the closure 10 functions as disclosed in FIGS. 1 through 5 and in the written description pertaining thereto.

Operation—FIGS. 1 through 5

Figure 4:
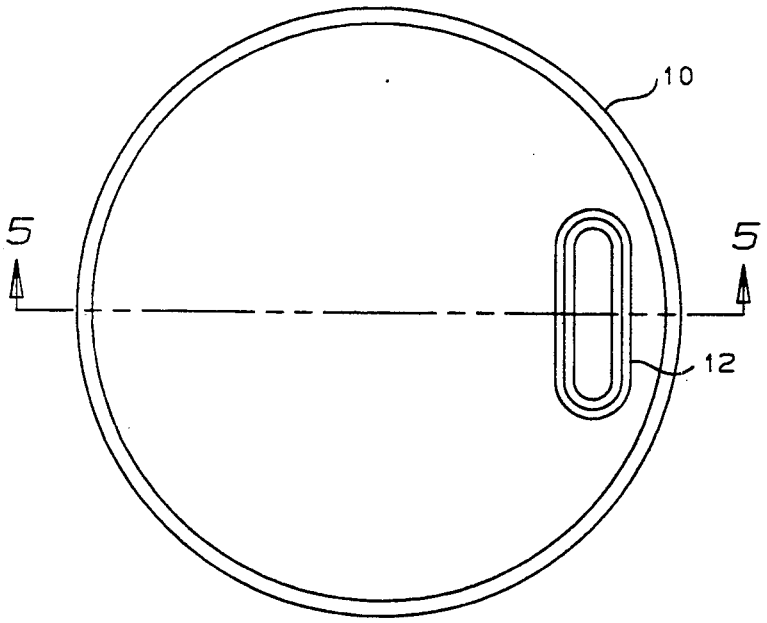
FIG. 4 is a top view of a spill-proof closure without the thin membrane shown in FIG. 1 and in FIG. 3.
Figure 5:
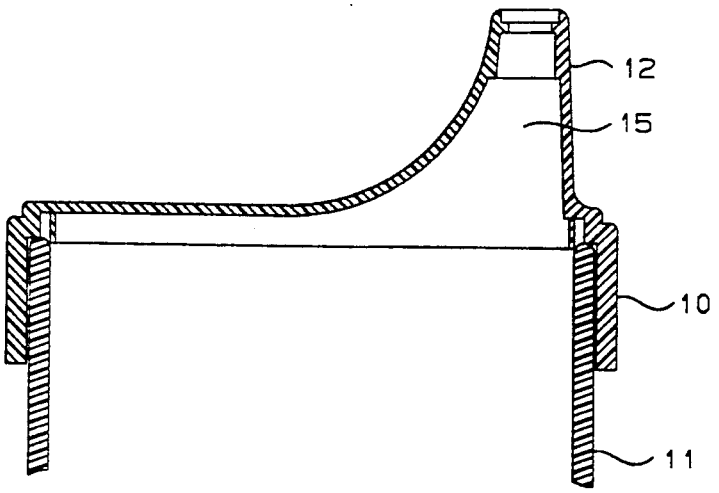
FIG. 5 is the cross-sectional view taken as indicated by section line 5—5 applied to FIG. 4.

After the closure 10 is manufactured to the form shown in FIG. 4, the thin membrane 13 is assembled or insert molded into the spout 12. The slit 14 is either molded into the thin membrane 13 or is formed with a sharp edge after the thin membrane 13 is produced. Now the closure 10 is in the closed position and takes the form shown in FIG. 1. Since the thin membrane 13 is biased to its manufactured position, the slit 14 will remain closed unless a partial vacuum or suction is applied to the thin membrane 13 at the upper end of the spout 12. The closure 10 is ready for use and can be attached to the beverage container 11.

Figure 3:
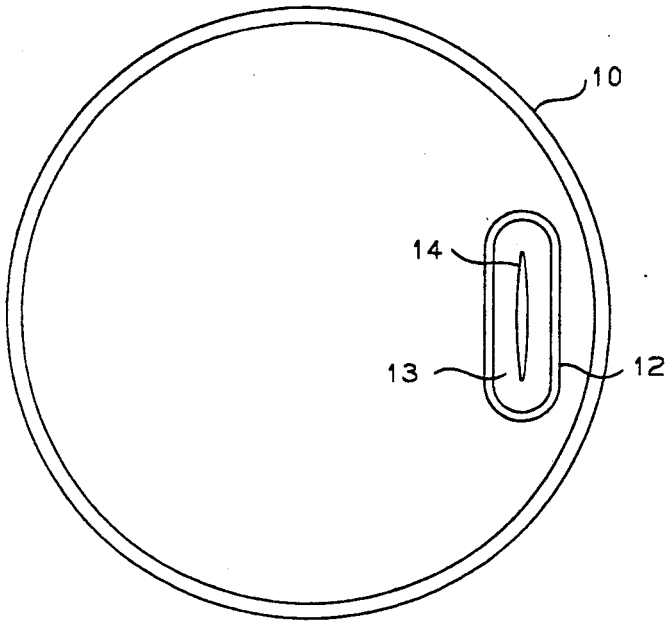
FIG. 3 is a top view of a spill-proof closure in the opened position as a result of suction applied by the user.

When consumption of the beverage in beverage container 11 is desired, the spout 12 is inserted into the mouth of a user. External suction applied by the user will stress the thin membrane 13 causing the slit 14 to form a small opening through the thin membrane 13 as shown in FIG. 3. This provides communication between the interior of the beverage container 11 and the user's mouth which allows for delivery of the contained beverage. When the suction is released the thin membrane 13, being biased to its manufactured position, will cause the slit 14 to reclose as shown in FIG. 1, thus denying communication between the interior and exterior of the beverage container 11. This closed position makes the closure 10, with the beverage container 11 attached, a spill-proof device even if tipped or overturned.

Summary, Ramifications, and Scope

The closure of the present invention provides the following advantages over prior embodiments:

1) The closure will eliminate spills even if the device is tipped or overturned.
2) It will be possible to drink from the container in a normal manner without removing the closure from the container.
3) The closure is a simple structure and may easily be manufactured on conventional plastic forming machines, thus it may be inexpensively mass produced.
4) The closure is a safe device and can be used by small children.

While embodiments of the invention have been described in detail, it is understood that other modifications and various embodiments thereof may be devised by one skilled in the art without departing from the spirit and the scope of the invention, as defined by the claims.

We claim:

1. A controllable valved closure for use in dispensing a beverage from a container, said closure comprising:

(a) a substantially planar cover portion conforming in shape to the opened end of said container;
(b) attachable means for selectively maintaining said closure in covering relation with said container;
(c) a spout having an outer end, said spout extending upwardly and outwardly from said cover portion;
(d) an elongated opening located near said outer end of said spout, said opening providing communication between the interior and exterior of said spout, and said opening being completely contained within the user's mouth during operation of the closure;
(e) a thin membrane having attachable means for attaching said thin membrane to an inner surface of said spout, said thin membrane covering said opening in said spout, said thin membrane being made of an elastomer which can be repeatedly stressed and unstressed and retain memory of its original position; and
(f) a single slit through a planar section of said thin membrane, said slit being straight and parallel to a long axis of said opening, said slit functioning to provide an opening through said thin membrane when suction is applied to said thin membrane and reseal, as a result of said thin membrane being biased to its manufactured position, when suction is removed from said thin membrane.

2. The controllable valved closure according to claim 1 wherein said thin membrane attachable means includes insert molding to said inner surface of said spout.

3. The controllable valved closure according to claim 1 wherein said planar section of said thin membrane is between 0.001 inches and 0.100 inches in thickness.

4. The controllable valved closure according to claim 1 wherein said thin membrane is made of Santoprene.

5. The controllable valved closure according to claim 1 wherein said spout is made of polypropylene.

6. The controllable valved closure according to claim 1 wherein said thin membrane is made of Kraton.

7. A controllable valved closure for use in dispensing a beverage from a container, said closure comprising:

(a) a substantially planar cover portion conforming in shape to the opened end of said container;
(b) attachable means for selectively maintaining said closure in covering relation with said container;
(c) an elongated passageway having an outer end, said passageway extending upwardly and outwardly from said cover portion;
(d) an opening located near said outer end of said passageway, said opening providing communication between the interior and exterior of said passageway, and said opening being completely contained within the user's mouth during operation of the closure;
(e) a thin membrane having attachable means for attaching said thin membrane to an inner surface of said closure, said thin membrane covering said opening in said passageway; and
(f) a slit through a planar section of said thin membrane, said slit functioning to provide an opening through said thin membrane when an external negative pressure exists and remain closed when internal and external pressures are equal.

8. The controllable valved closure according to claim 7 wherein said thin membrane attachable means includes insert molding to said inner surface of said closure.

9. The controllable valved closure according to claim 7 wherein said planar section of said thin membrane is between 0.001 inches and 0.100 inches in thickness.

10. The controllable valved closure according to claim 7 wherein said slit is curved with respect to a plane perpendicular to said thin membrane.

11. The controllable valved closure according to claim 9 wherein said elongated passageway is made of polypropylene.

12. The controllable valved closure according to claim 9 wherein said thin membrane is made of Santoprene.

13. The controllable valved closure according to claim 9 wherein said thin membrane is made of Kraton.

14. A controllable valved closure for use in dispensing a beverage from a container, said closure comprising:

(a) a substantially planar cover portion conforming in shape to the opened end of said container;
(b) attachable means for selectively maintaining said closure in covering relation with said container;
(c) an elongated passageway having an outer end, said passageway extending upwardly and outwardly from said cover portion;
(d) an opening in said closure which communicates between the interior and exterior of said passageway;
(e) a thin membrane having attachable means for attaching said thin membrane to the inner surface of said closure, said thin membrane sealing off said opening in said closure; and
(f) a disjoined portion within said thin membrane, said disjoined portion functioning to provide a flow passage through said thin membrane when said thin membrane is stressed and said disjoined portion forming a seal when said thin membrane is unstressed.

15. The controllable valved closure according to claim 14 wherein said thin membrane attachable means includes insert molding to said inner surface of said closure.

16. The controllable valved closure according to claim 14 wherein said planar section of said thin membrane is between 0.001 inches and 0.100 inches in thickness.

17. The controllable valved closure according to claim 15 wherein said thin membrane is made of an elastomer.

18. The controllable valved closure according to claim 15 wherein said elongated passageway is made of a rigid material.

19. The controllable valved closure according to claim 15 wherein said disjoined portion is a plurality of holes.

20. The controllable valved closure according to claim 15 wherein said disjoined portion is a plurality of slits.

* * * * *

UNITED STATES PATENT AND TRADEMARK OFFICE

CERTIFICATE OF CORRECTION

PATENT NO. : 5,186,347

DATED : February 16, 1993

INVENTOR(S) : Mark A. Freeman and Timothy K. Stringer

It is certified that error appears in the above-indentified patent and that said Letters Patent is hereby corrected as shown below:

Column 4, line 59, delete "the inner surface" and insert --an inner surface--; column 4, line 62, after "within" insert -- a planar section of --.

Signed and Sealed this

Fourteenth Day of September, 1999

*Attest:*

Q. TODD DICKINSON

*Attesting Officer*

*Acting Commissioner of Patents and Trademarks*